US008267222B2

(12) United States Patent
Cui

(10) Patent No.: US 8,267,222 B2
(45) Date of Patent: Sep. 18, 2012

(54) COMPACT SCISSORS LIFT

(76) Inventor: Kan Cui, Sammamish, WA (US)

( * ) Notice: Subject to any disclaimer, the term of this patent is extended or adjusted under 35 U.S.C. 154(b) by 343 days.

(21) Appl. No.: 12/656,504

(22) Filed: Feb. 1, 2010

(65) Prior Publication Data

US 2010/0193290 A1 Aug. 5, 2010

Related U.S. Application Data

(60) Provisional application No. 61/202,203, filed on Feb. 5, 2009.

(51) Int. Cl.
*E06C 5/00* (2006.01)

(52) U.S. Cl. ..... 182/69.5

(58) Field of Classification Search ..... 182/69.5; 187/240, 244, 243, 211, 269; 254/122; 248/357, 248/157, 277.1, 651, 125.2, 178.1, 183.1; 180/417, 253, 434–437
See application file for complete search history.

(56) References Cited

U.S. PATENT DOCUMENTS

| | | | | | |
|---|---|---|---|---|---|
| 3,110,476 | A | * | 11/1963 | Farris | 254/122 |
| 4,113,065 | A | * | 9/1978 | Sikli | 187/243 |
| 4,114,724 | A | | 9/1978 | Doolittle | |
| 4,130,178 | A | * | 12/1978 | Smith, Jr. | 182/141 |
| 4,557,346 | A | | 12/1985 | Guignard et al. | |
| 4,930,598 | A | | 6/1990 | Murill et al. | |
| 5,431,247 | A | * | 7/1995 | Kishi | 182/69.4 |
| 5,890,737 | A | * | 4/1999 | Hutka | 280/755 |
| 6,044,927 | A | | 4/2000 | Newlin | |
| 6,561,546 | B2 | * | 5/2003 | Puszkiewicz et al. | 280/755 |
| 6,571,913 | B2 | * | 6/2003 | Puszkiewicz et al. | 182/69.1 |
| 6,595,322 | B2 | | 7/2003 | Winter | |
| 7,281,736 | B2 | | 10/2007 | Sannah et al. | |
| 2008/0273826 | A1 | | 11/2008 | Muller | |

FOREIGN PATENT DOCUMENTS

| | | |
|---|---|---|
| EP | 0854110 | 7/1998 |

* cited by examiner

*Primary Examiner* — Darnell Jayne
*Assistant Examiner* — Kristine Florio
(74) *Attorney, Agent, or Firm* — Richard C. Litman

(57) ABSTRACT

The compact scissors lift includes a chassis having a body, a pair of wheels disposed at one end and a pair of steering wheels at the opposite end; a lifting linkset assembly disposed substantially within the base, the linkset assembly shaped to form space for the steering wheels; a steering system operatively connected to the steering wheels in front of the linkset assembly; and a deployable safety guard mechanism, on at least one side of the chassis. Having the linkset assembly within the chassis body reduces the overall stow height of the lift to thereby increase access to work areas, decrease physical expenditure on the user, increase stable steering and increase safe operation on potentially hazardous terrain.

14 Claims, 14 Drawing Sheets

COMPACT SCISSORS LIFT

CROSS-REFERENCE TO RELATED APPLICATION

This application claims the benefit of U.S. Provisional Patent Application Ser. No. 61/202,203, filed Feb. 5, 2009.

BACKGROUND OF THE INVENTION

1. Field of the Invention

The present invention relates to elevating devices, more specifically a compact scissor lift capable of lifting personnel and/or loads for subsequent work.

2. Description of the Related Art

Aerial platforms have been used to raise work personnel and/or lift materials to elevated locations. These platforms or lifts tend to be remote operated and comprise of three main assemblages. At the base is a chassis which includes wheels and a steering mechanism, a platform to carry personnel and/or material, and a system of linksets between the chassis and the platform, the linksets being the main mechanic for raising and lowering the platform via a main lift cylinder. The aggregate height of a typical aerial lift is relatively tall, so that a person of average height may have some difficulty climbing into the platform and/or loading materials thereon. Moreover, some work locations may not have openings tall enough to allow passage of the typical aerial lift. It would be beneficial in the art to provide a lift device that increase the work locale versatility, reduce physical strain on the operator when climbing into or loading the platform and increase the stability of the lift during lifting operations.

Thus, a compact scissors lift design solving the aforementioned problems is desired.

SUMMARY OF THE INVENTION

The compact scissors lift includes a chassis having a body, a pair of wheels disposed at one end and a pair of steering wheels at the opposite end; a lifting linkset assembly disposed substantially within the base, the linkset assembly shaped to form space for the steering wheels; a steering system operatively connected to the steering wheels in front of the linkset assembly; and a deployable pothole protection safety guard on at least one side of the chassis.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 10:
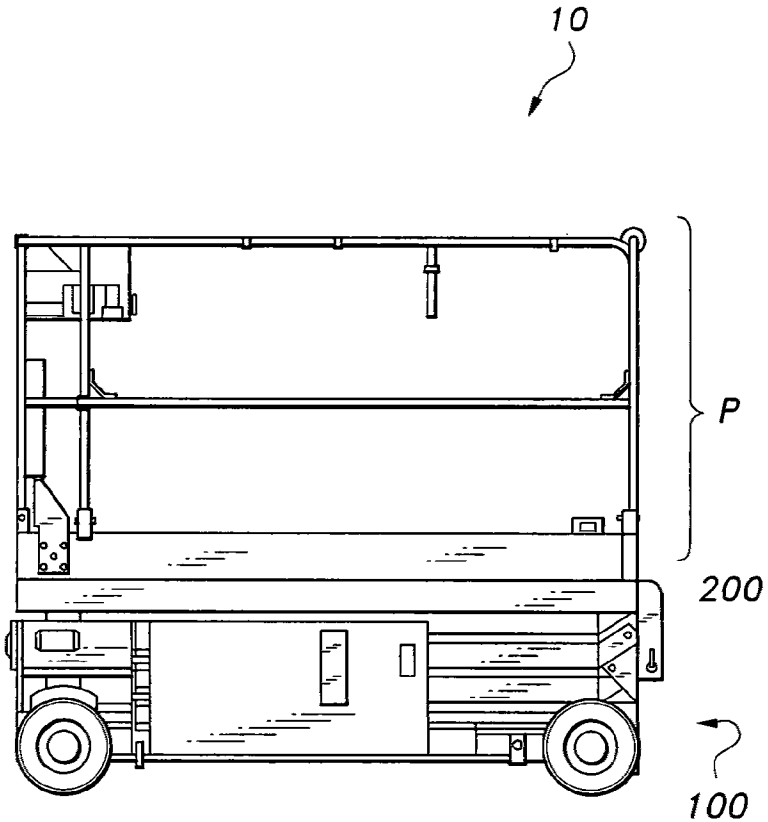
FIG. 10 is a side view of the compact scissors lift according to the present invention.
Figure 9:
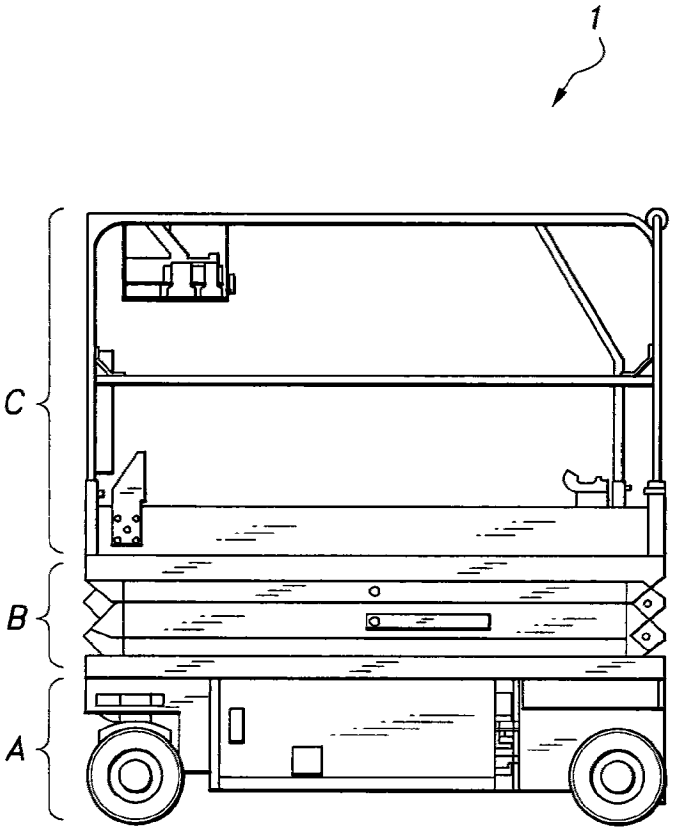
Fig. 9 PRIOR ART
FIG. 9 is a side view of a Prior Art scissor lift.

The present invention relates to a compact scissor lift having features that reduces the overall height to thereby increase access to work areas, decrease physical expenditure on the user, increase stable steering and increase safe operation on potentially hazardous terrain. To better illustrate how the compact scissor lift 10 has been reduced in height, attention is directed to FIG. 9. The Prior Art scissor lift 1 includes, from the bottom up, a chassis A, a linkset assembly B, and a lift platform C, each component being disposed on top of the other. In comparison, the compact scissor lift 10, as shown in FIG. 10, includes, from the bottom up, a chassis 100, a linkset assembly 200 disposed within the body of the chassis and a lift platform P operatively connected to the linkset assembly 200. In industry, the platform height is standardized so both platforms C and P are of the same height. The compact scissor lift 10 has been shortened, i.e. made more compact, by placing or merging the linkset assembly 200 within the chassis 100. In this example, the stow height difference between the two lifts is about 7 in., which may vary depending on, inter alia, model and the number of individual linksets.

Figure 1:
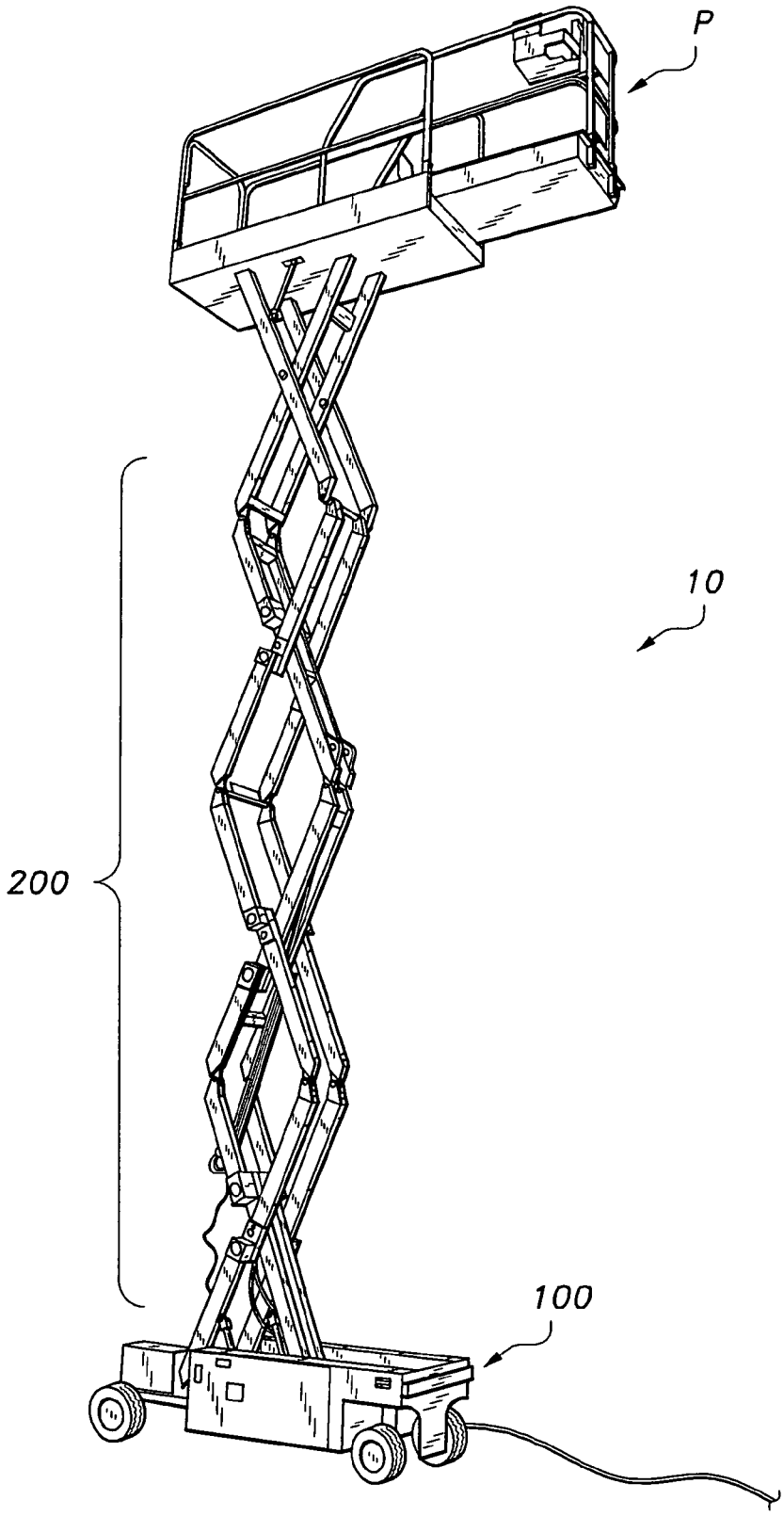
FIG. 1 is an environmental, perspective view of a compact scissors lift according to the present invention.
Figure 2:
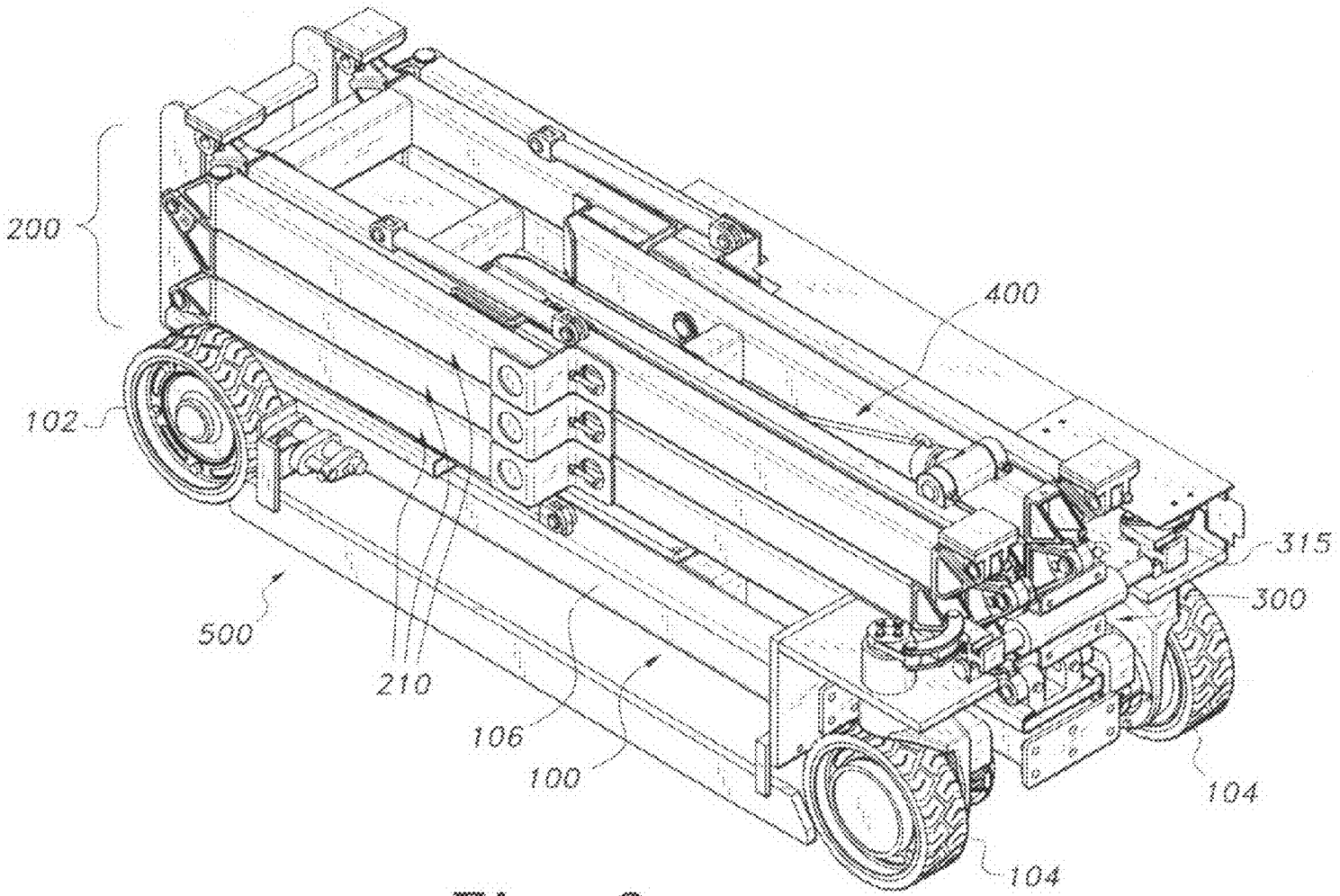
FIG. 2 is a perspective view of the chassis and linkset assembly of the compact scissors lift in a stowed condition according to the present invention.

While the above generally illustrate reduction of height, the following will describe how to accomplish this reduction. Referring to FIG. 2, the mobile chassis 100 includes a substantially rectangular body (some of the paneling not shown) with a pair of fixed axis wheels 102 at one end and a pair of steering wheels 104 operatively disposed at the other end. Frame members 106 form the base of the chassis body. The linkset assembly 200 is operatively disposed within the chassis body on the base, and in this embodiment, the linkset assembly 200 includes a stack of three linksets or lift arm assemblies 210.

Figure 3A:
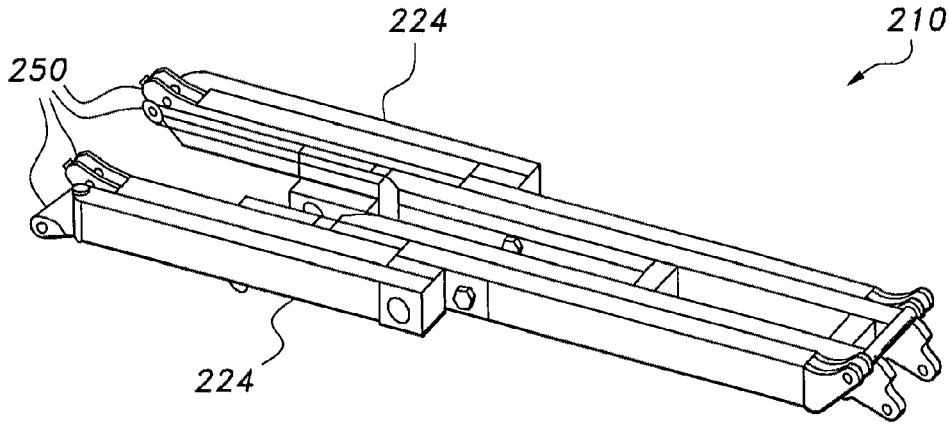
FIG. 3A is a perspective view of one of the linksets in the compact scissors lift in a closed or stowed position according to the present invention.
Figure 3B:
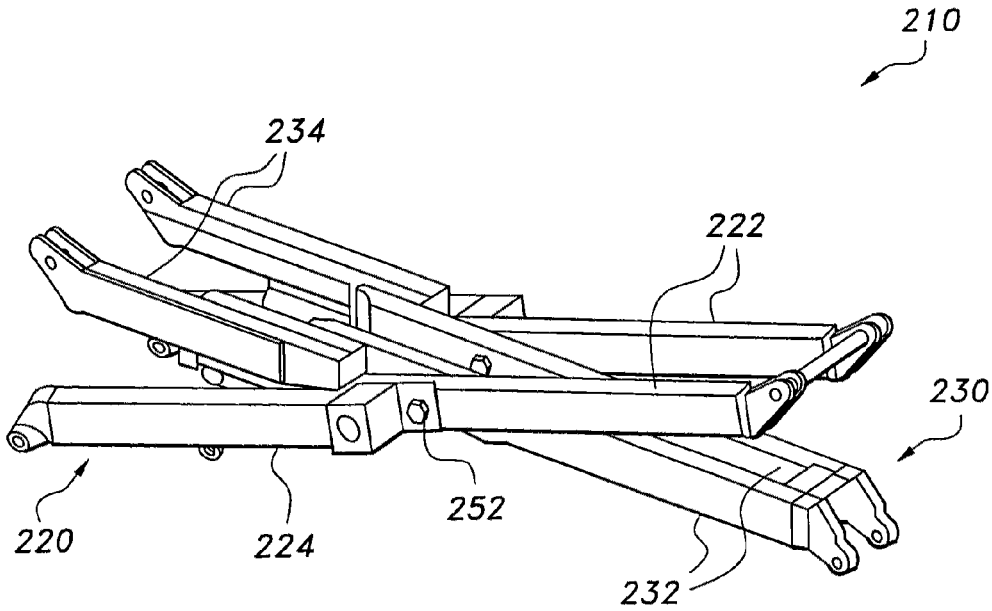
FIG. 3B is a perspective view of one of the linksets in the compact scissors lift in an open or lifting position according to the present invention.
Figure 4:
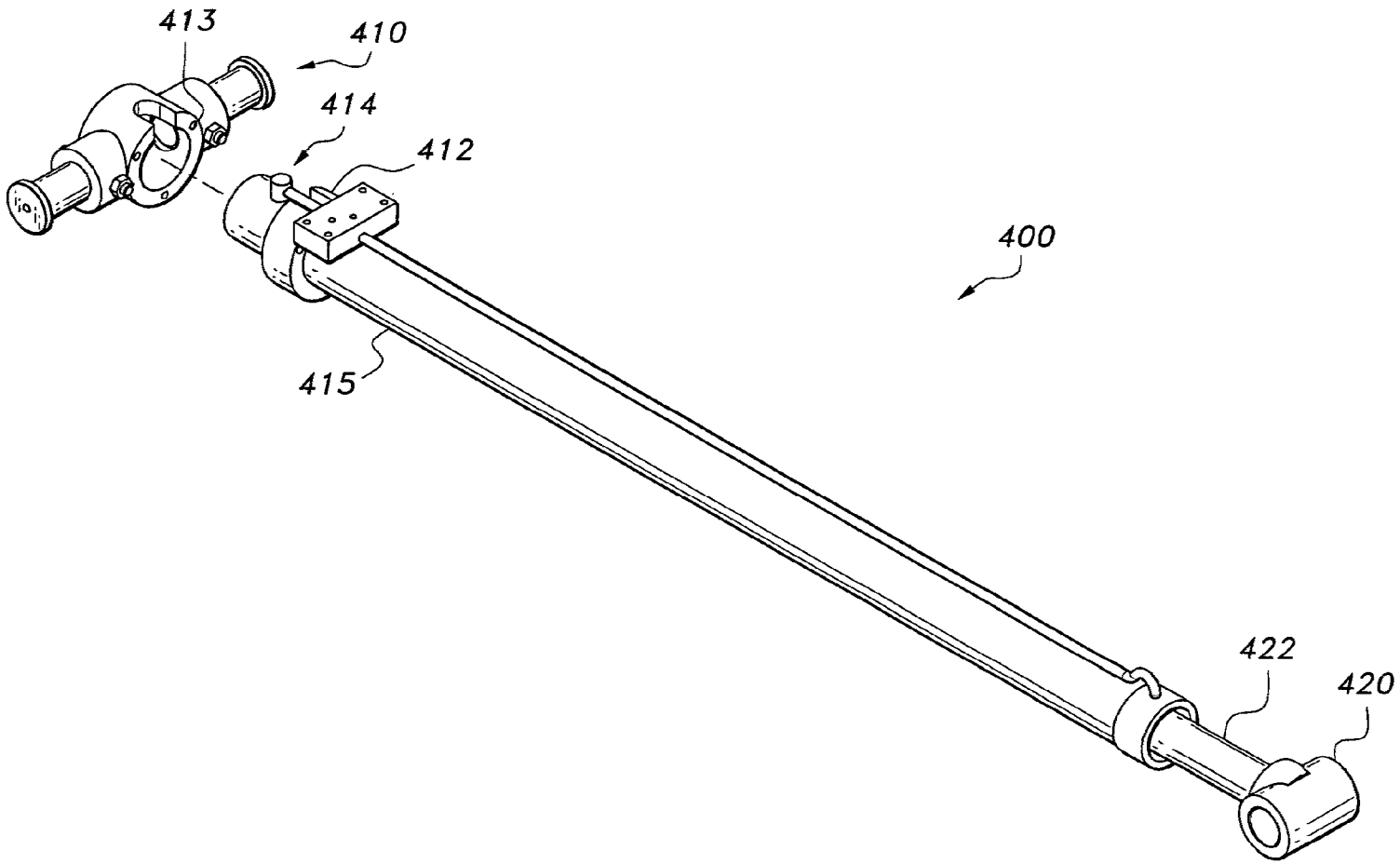
FIG. 4 is an exploded view of the main lift cylinder of the compact scissors lift according to the present invention.

Referring to FIGS. 3A-3B, the framework of each linkset 210 is of uneven widths or a stepped rectangular shape. The space formed by the difference between the wider width section and the shorter width section provides room for the steering wheels 104 to steer, the steering wheels 104 being disposed adjacent the shorter width end of the linkset 210. The linkset 210 may be composed of an outer lift support frame 220 and an inner lifting frame 230 nested within the outer lift support frame 220, both frames being pivotable with respect to each other. The outer lift support frame 220 may be formed by inner support arms 222 rigidly attached to outer support arms 224. Accordingly, the inner lifting frame 230 may also be similarly formed with inner lifting arms 232 rigidly attached to outer lifting arms 234. The outer support arms 224 and the outer lifting arms 234 together define the wider width section of the linkset 210 while the inner support arms 222 and the inner lifting arms 232 together define the shorter width section of the linkset 210. Note that despite the different width sections, the overall length of the linkset 210 is uniform. Although each of the frames have been disclosed as having rigidly attached arms, e.g. by welding, these frames may also be formed by cast molding. Pivot extensions 250 disposed at the distal ends of each of the arms provide pivotable attachment points for operative connection to subsequent linksets 210 and/or the chassis 100. In operation, both frames pivot about the pivot pins 252 located about midway along the length of the linkset 210 in a scissor-like manner to raise or lower structure that may be placed on the top thereof. Compare the stowed condition shown in FIG. 3A and the lift condition shown in FIG. 3B.

Figure 5A:
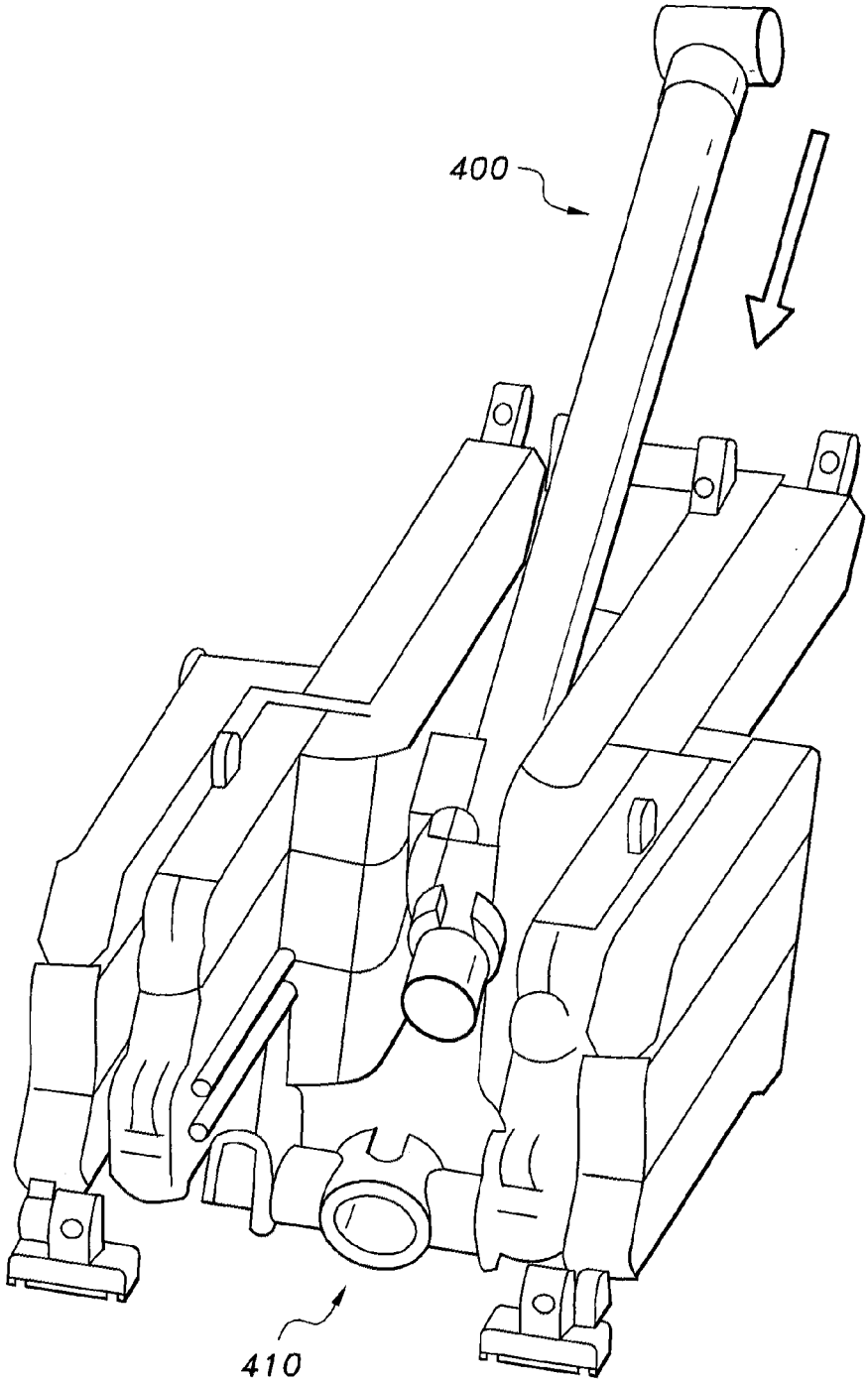
FIG. 5A is a perspective view illustrating installation of the main lift cylinder of the compact scissors lift according to the present invention.
Figure 5B:
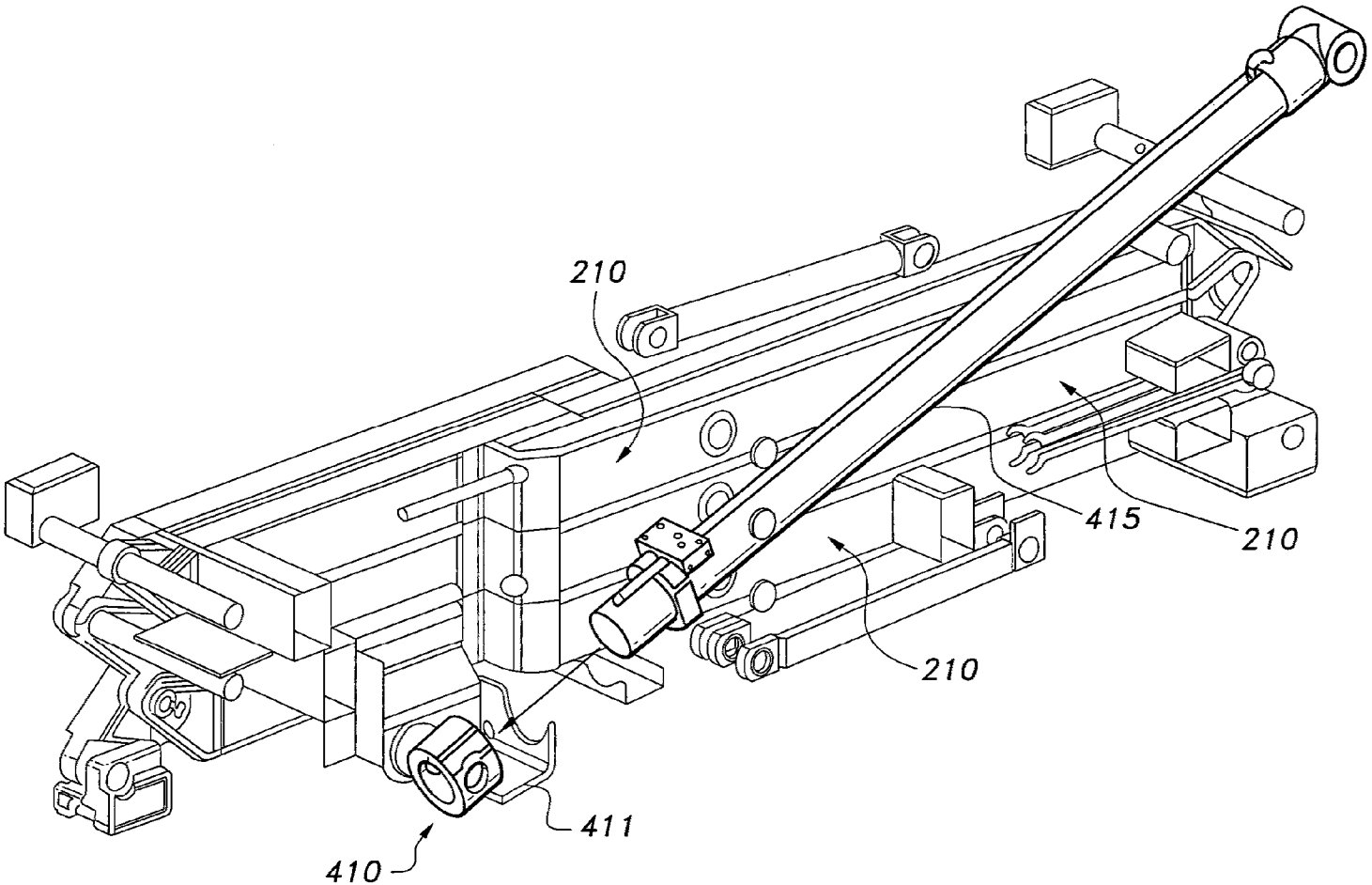
FIG. 5B is a cutaway perspective view illustrating the main lift cylinder being inserted into the collar of the compact scissors lift according to the present invention.
Figure 5C:
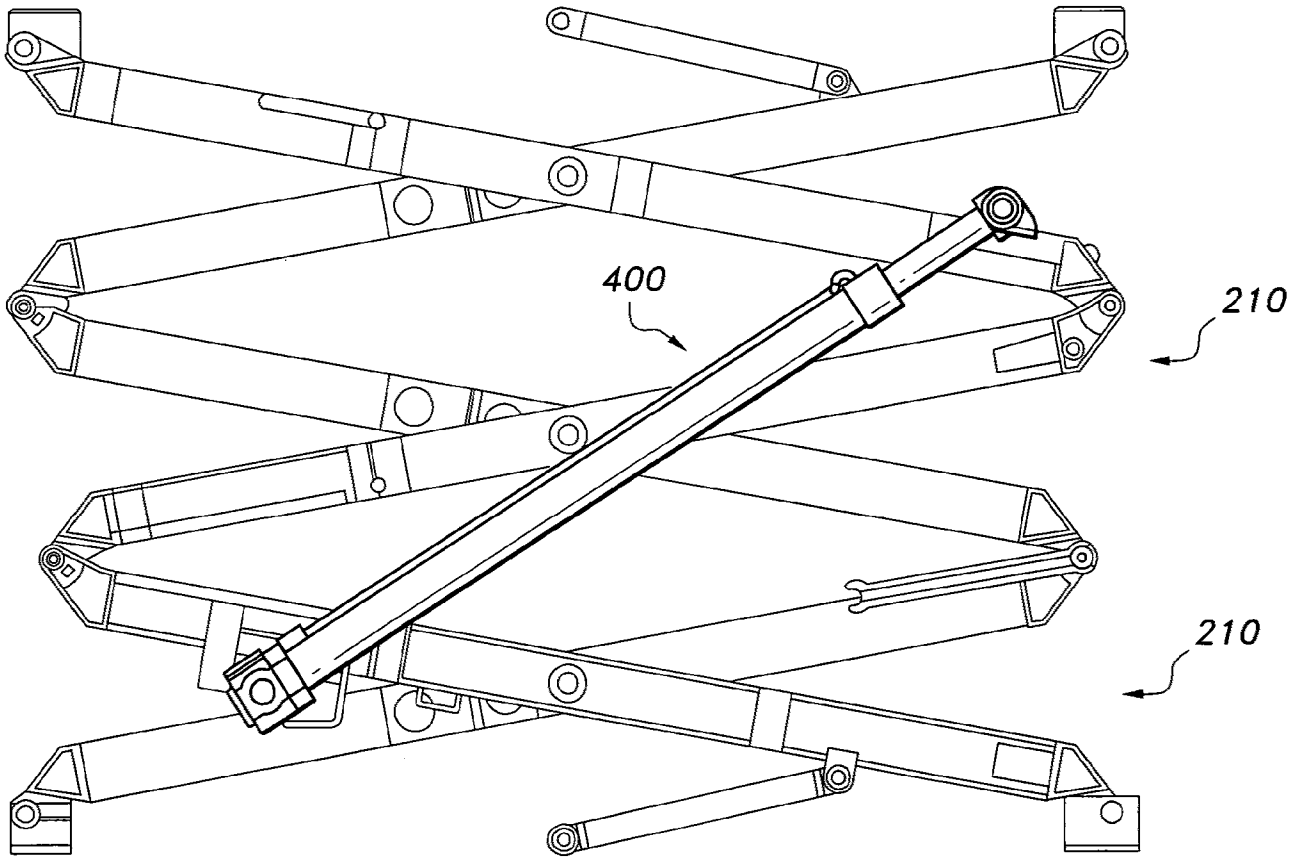
FIG. 5C is a side view illustrating an alternative connection of the main lift cylinder according to the present invention.

To activate the linkset assembly 200 for raising or lowering the platform P, a hydraulic motor or main hydraulic lift cylinder 400 may be operatively connected between the chassis 100 and one of the linksets 210 or between any two linksets 210 as shown in FIG. 5C. Due to the heavy and cumbersome nature of the main lift cylinder 400 during installation, the present compact scissor lift 10 is configured to ease such strain.

As shown in FIGS. 5A and 5B, the main lift cylinder 400 includes a pivotable locking collar 410 separate from the cylinder barrel 415. This pivotable locking collar 410 may be pre-installed on a cylinder mount 411 rigidly attached to either the chassis 100 or to any link or support arm of linkset 210. Once the locking collar 410 has been mounted, the installer(s) may simply insertably mount the locking end 414. Locking of the cylinder 400 to the collar 410 may be facilitated by pins (not shown) mounted in the bores 413 on the collar 410. These pins may be inserted into corresponding bores in the ring seat 412 welded on the cylinder barrel 415. The location of the collar 410 along the length of the cylinder barrel 415 may be adjusted to adjust the stroke of the main lift cylinder 400. The opposite end of the main cylinder 400 includes a pivot mount 420 attached to the cylinder rod 422. The pivot mount 420, in turn, may be operatively attached to one of the linksets 210 corresponding to a predetermined tilt angle for the compact scissor lift 10. It should be noted that the locking collar 410 and the corresponding ring seat 412 may be configured so that the cylinder rod 422 may be coupled thereto instead of the cylinder barrel 415.

In light of the above, it is much easier to remove or install the cylinder barrel 415 for assembly or maintenance, since the installer(s) or user can easily access and manipulate the cylinder barrel 415 during those situations without having to disassemble the linkset assembly 200. In contrast, a traditional main lift cylinder does not include a separate pivotable collar but instead includes opposite, integral pivot mounts that must be mounted to a scissor lift frame. Any handling of the main lift cylinder must be facilitated with care so that marring or damaging of surrounding parts of the lift may be minimized. However, the weight and configuration of the traditional lift cylinder increases the risks of damage during handling. As a consequence, the installer(s) must disassemble the traditional linkset assembly in order to perform maintenance or installation of the traditional lift cylinder resulting in unnecessary lengthy downtimes.

Figure 6A:
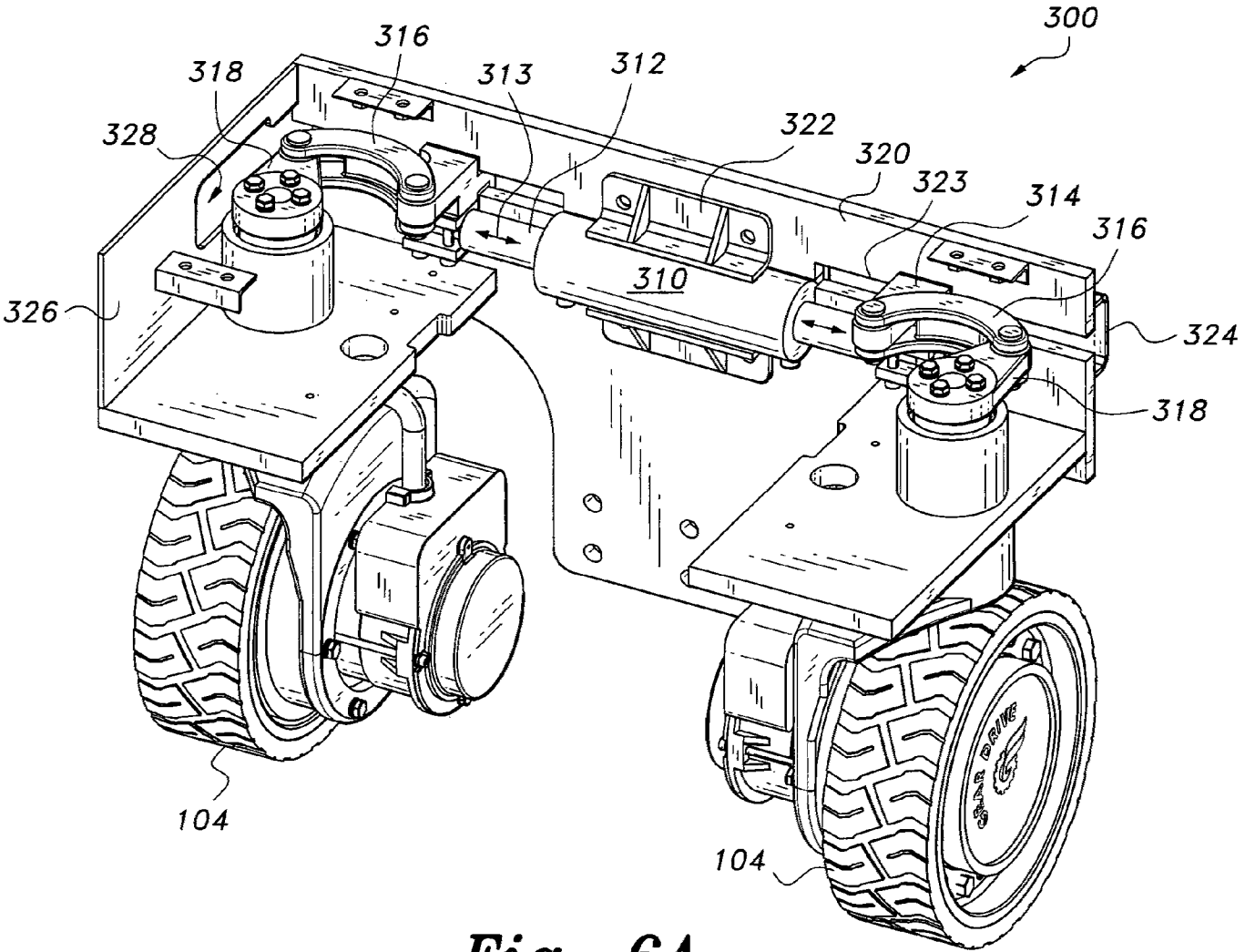
FIG. 6A is a perspective view of the steering system of compact scissors lift according to the present invention.

To steer the compact scissor lift 10, a steering system 300 is provided on the chassis 100 adjacent the shorter width end of the linkset assembly 200. See FIGS. 2, 6A and 6B. The steering system 300 includes a double acting, main steering hydraulic cylinder 310 rigidly attached to steering chassis frame 320 between holding brackets 322. The ends of the steering rod 312 may be attached to a slidably mounted extension connector 314. Each extension connector 314 is a robust, substantially L-shaped bracket with one end clamped to the respective end of the steering rod 312 and the other end pivotally connected to one end of a steering tie link 316. The other end of each of the steering tie links 316 may be pivotally connected to the steering arm of the respective wheel 104. Thus, reciprocation of the steering rod 312 (indicated by arrows 313) concurrently reciprocates extension connectors 314 causing the tie links 316 to translate and leverage the steering arms 318 and thereby rotate the steering wheels 104 about respective virtual steering axes. The side panels 326 include a clearance slot 328 permitting the tie links 316 and the steering arms 318 to pass through during extreme ends of steering travel.

Regarding the extension connectors 314, these connectors were applied to preserve the overall compact nature of the current compact scissor lift 10. In other words, it is not desirable to extend the wheelbase of the device. To that end, the extension connector 314 allows the steering cylinder 310 to be mounted a short distance forward of the chassis 100 and the short width end of the linkset assembly 200 to thereby allow clearance for the linkset assembly 200 and preserve the steering geometry. Due to the amount of bending forces that the extension connectors 314 may experience during a working operation and the potential damage to the steering system as a result, both the extension connectors 314 and the steering chassis frame 320 are provided with features to compensate. To that end, a pair of extending slots 323 are formed in the steering chassis frame 320. A rectangular rail 324 is provided at the rear of the steering chassis frame 320 covering the slots 323. The slots 323 and the rail 324 together form a T-shaped channel where a corresponding T-shaped slider 315 formed on the rear of the respective extension connector 314 may ride. This configuration ensures that the extension connector 314 will overcome any bending forces within engineered limits while reciprocating in response to movement of the steering rod 312.

Figure 6B:
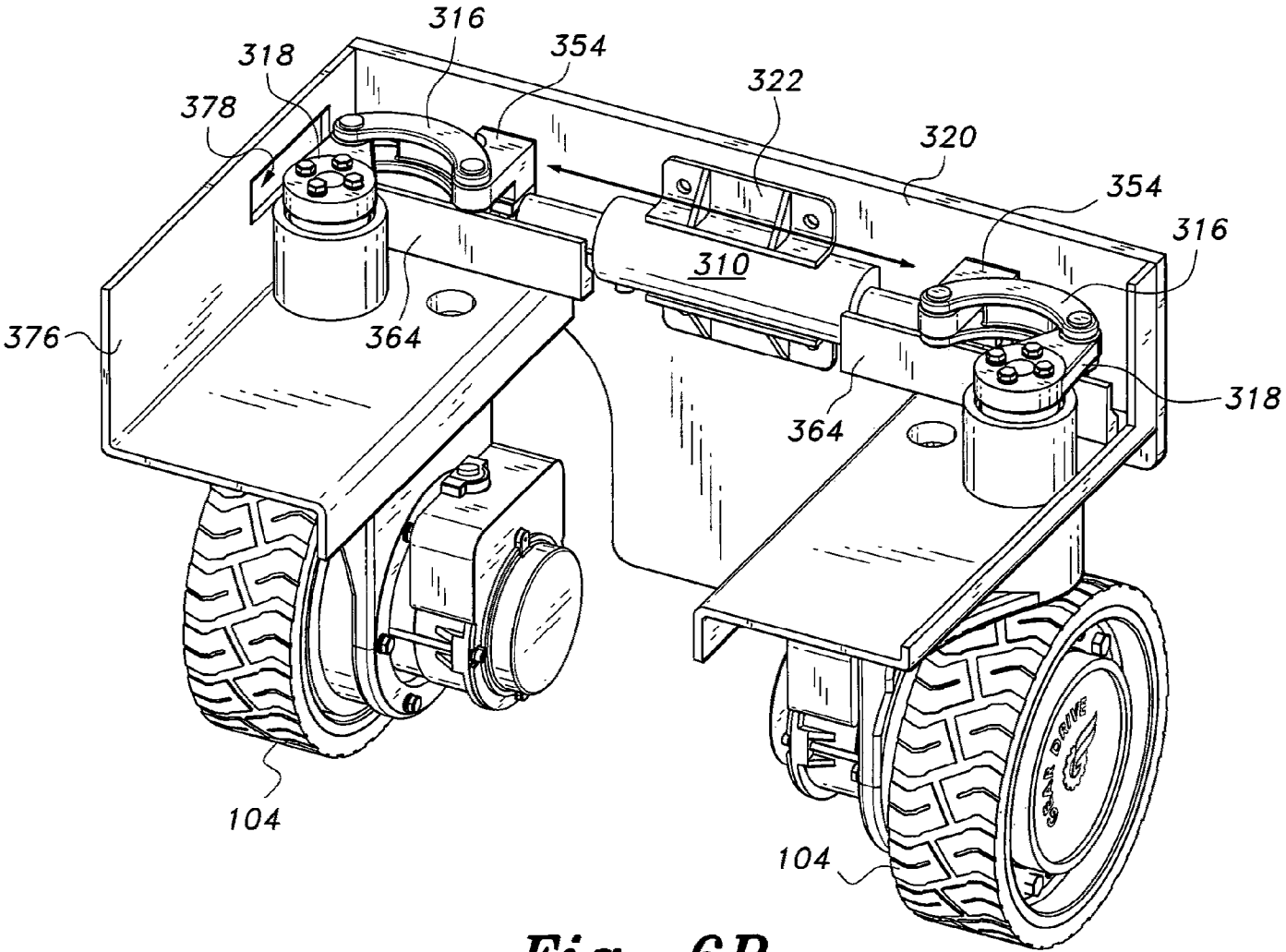
FIG. 6B is a perspective view of an alternative steering system for the compact scissor lift according to the present invention.

An alternative arrangement for incorporating the extension connectors is shown in FIG. 6B. In this embodiment, the slots 323 and the rail 324 has been replaced with a bar or rail 364. Each rail 364 may be an elongate L-shaped block forming a stepped ledge upon which a respective extension connector 354 may ride. Each rail 364 is spaced from the front of the steering chassis frame 320 such that a track or sliding channel is formed between the rail 364 and the steering chassis frame 320. In this manner, reciprocation of the extension connectors 354 is confined while the contact areas of the extension connectors 354 counterbalance the bending forces that the extension connectors 354 may experience during operation. The steering system shown in FIG. 6B functions in a similar manner to the one shown in FIG. 6A in all other aspects including the side panel 376 having a clearance slot 378 for the tie links 316 and the steering arms 318.

Figure 7A:
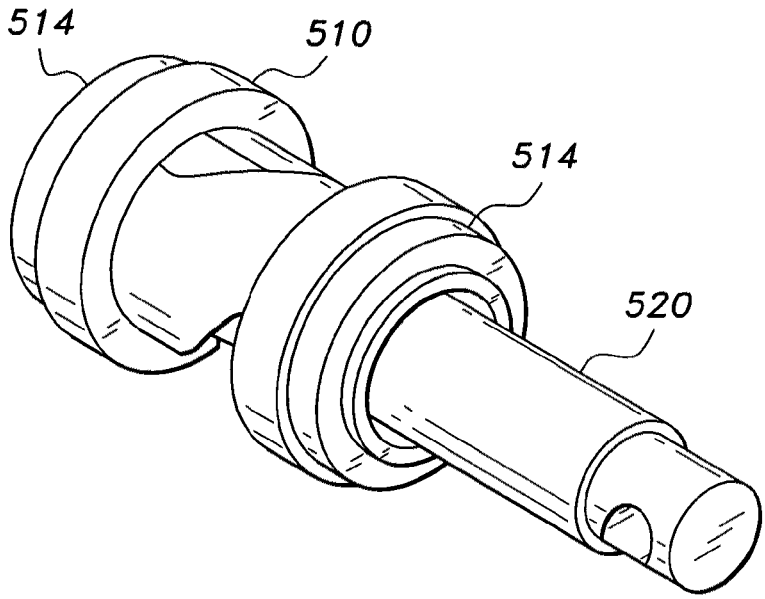
FIG. 7A is a perspective view of a helical screw for the automatic safety guard mechanism of the compact scissors lift according to the present invention.
Figure 7B:
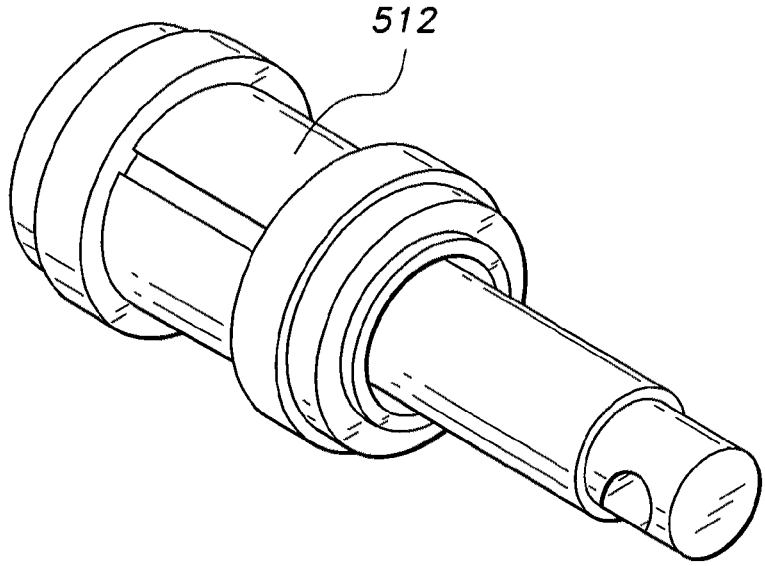
FIG. 7B is a perspective view of the assembled helical screw system for the automatic safety guard mechanism of the compact scissors lift according to the present invention.

Referring to FIGS. 2, 7A and 7B, the compact scissor lift 10 includes a safety mechanism 500 that automatically deploys a guard to stabilize the compact scissor lift 10 during operation on an uneven terrain, e.g. potholes. Further details of the safety mechanism 500 may be found in the co-pending application Ser. No. 12/292,120 filed on Nov. 12, 2008. In the current compact scissor lift 10, the helical drive mechanism includes a cast female helical screw 510 rotatably mounted to a drive rod 520 via thrust bearings 514. Partial sleeves 512 may be welded to the female screw 510 to form the male helical screw portion of the helical drive mechanism.

Figure 8A:
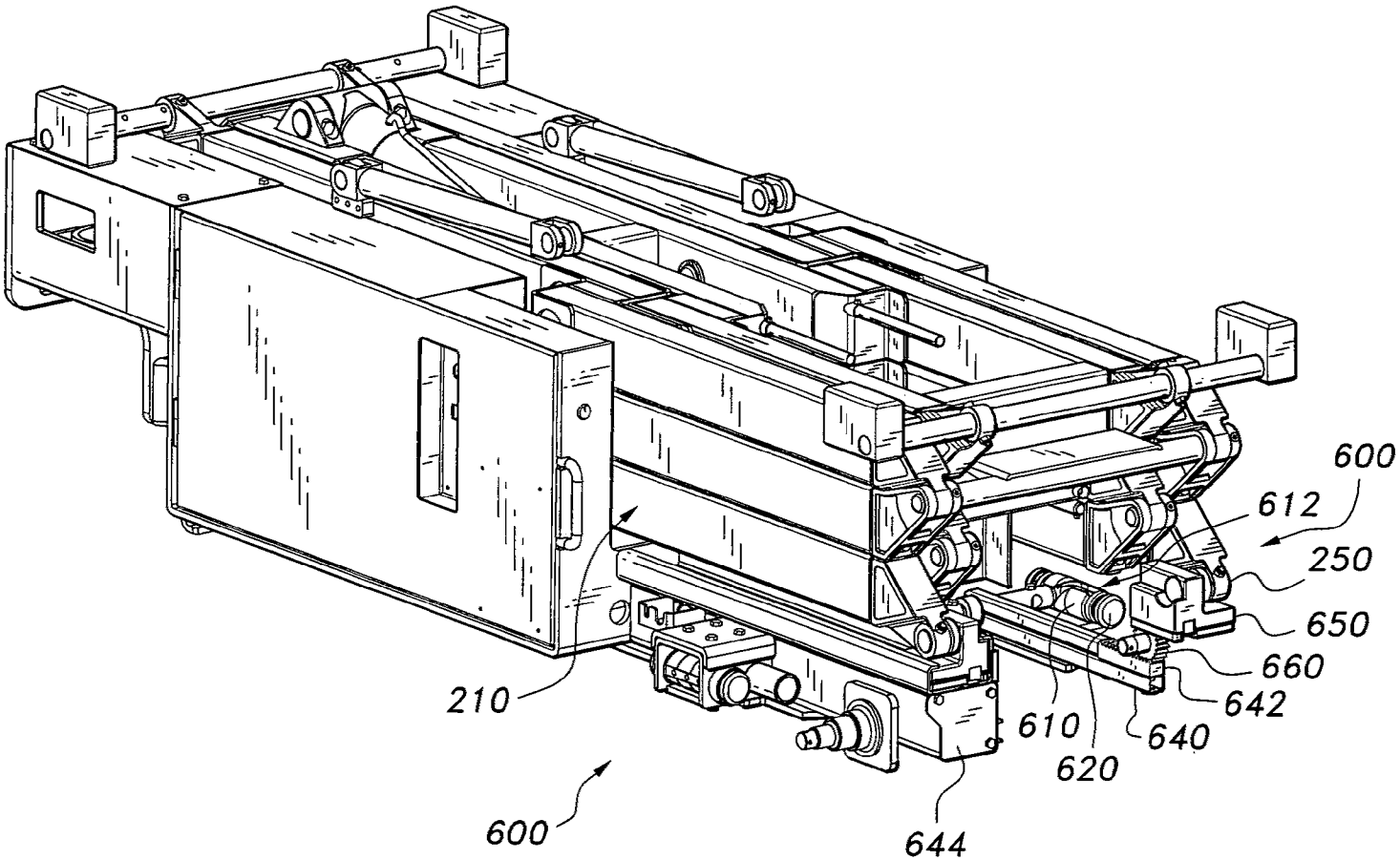
FIG. 8A is a top, partial perspective view of the safety mechanism for the compact scissor lift in a stowed state according to the present invention.
Figure 8B:
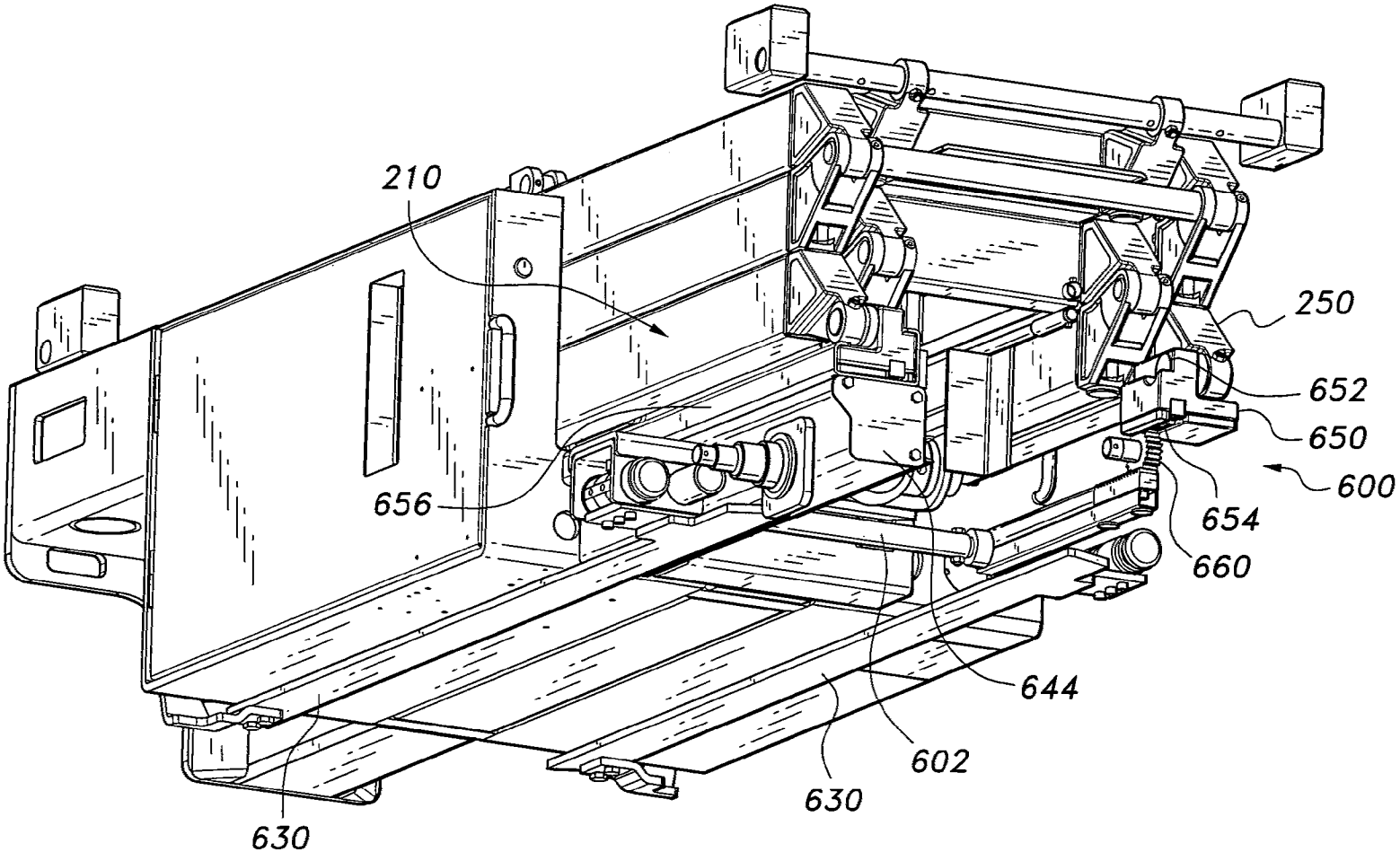
FIG. 8B is a bottom, partial perspective view of the safety mechanism for the compact scissor lift in the stowed stated according to the present invention.
Figure 8C:
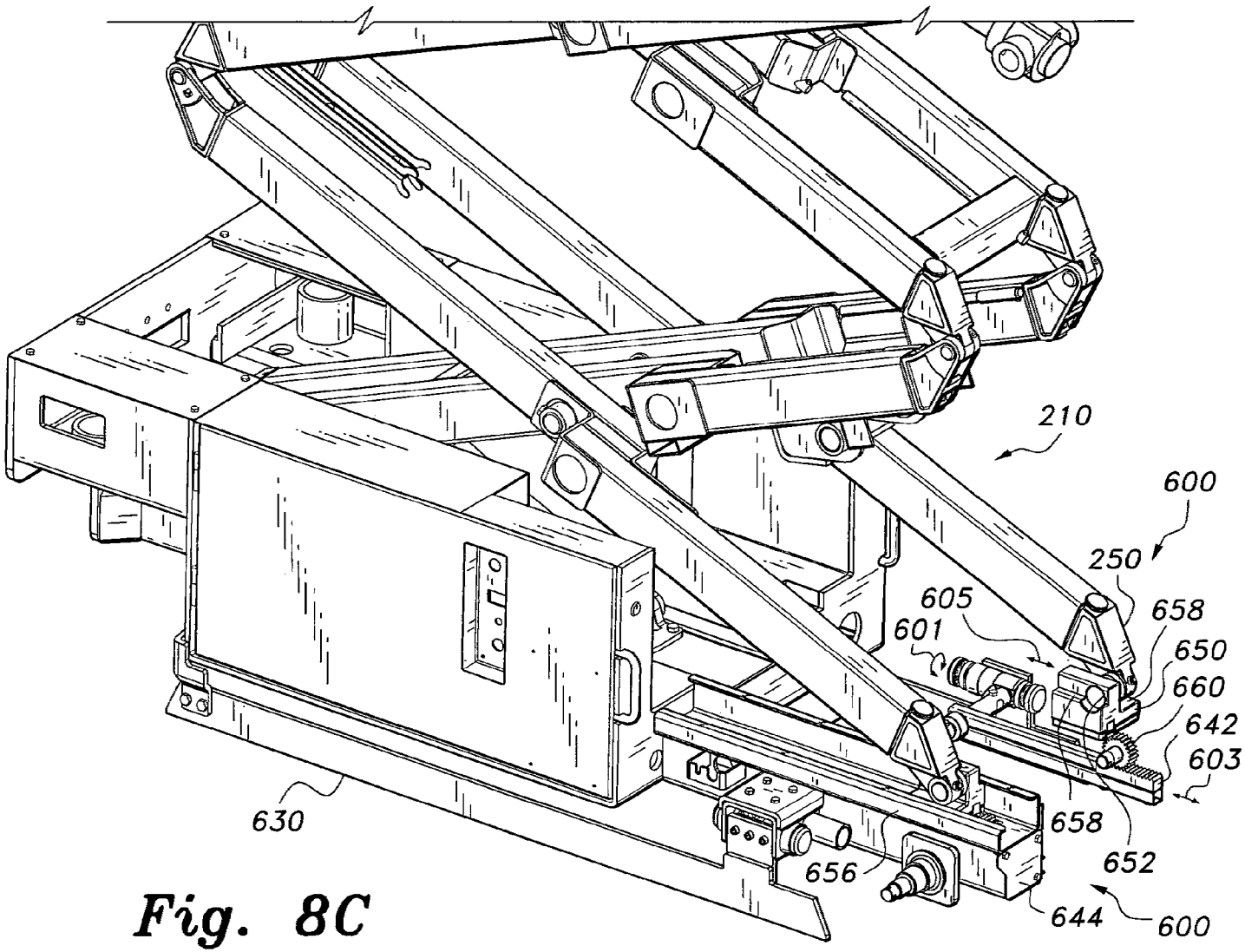
FIG. 8C is a partial perspective view of the safety mechanism for the compact scissor lift in a deployed state according to the present invention.

An alternative safety mechanism 600 is shown in FIGS. 8A-8C. In this embodiment, an automatic safety guard 630 is deployed depending on whether the platform is raised and lowered. To facilitate, the safety mechanism 600 includes a guard drive member or bar 602 disposed across a substantial width of the linkset assembly 200. Each opposite end of the guard drive bar 602 forms a follower operatively engaged inside the helical slot 612 of a female helical screw 610. The female helical screw 610 is similar to the female helical screw 510 and includes a drive rod 620 attached to the safety guard 630. As the follower reciprocates inside the helical slot 612 to the extreme limits thereof, the follower forces rotation of the female helical screw 610, indicated by arrow 601, to deploy (FIG. 8C) or stow (FIG. 8A) the safety guard 630.

The drive mechanism for reciprocating the guard drive bar 602 may be a rack and pinion system as shown in FIGS. 8A-8C. The drive mechanism includes a pair of spaced, elongate driven bars 640 with each having one end fixedly attached to the guard drive bar 602 and a lower rack 642 disposed at the opposite end. The teeth of the rack 642 are oriented upward. Each driven bar 640 is constrained to reciprocate within rails disposed inside rail housing 644, the reciprocation indicated by arrow 603.

To drive the driven bars 640, the drive mechanism includes a driving member or slider 650 slidably mounted within a channeled rail 656 and adapted to reciprocate therein as indicated by arrow 605. The slider 650 may be a substantially L-shaped block with ledge surfaces 658 corresponding to the shape of the channeled rail 656. This configuration ensures that the movement of the slider 650 is confined to reciprocation rather than elliptical or any other undesirable motion. Note that the channeled rail 656 is disposed atop the rail housing. The upright portion of the slider 650 includes a bore 652 to pivotably mount the slider 650 to one of the pivot extensions 250 on the lowermost linkset 210. The horizontal portion of the slider 650 forms a sliding base and at the bottom thereof, includes an upper rack 654 with downwardly oriented teeth. A pinion or gear 660 is disposed between the rack 654 and the rack 642 and meshed therewith to transfer motive forces between the racks. It is noted that the position of the pinion 660 is stationary with respect to the upper rack 654 and the lower rack 642. Due to the orientation of the respective rack teeth, movement of the upper rack 654 in one direction causes a corresponding movement of the lower rack 642 in the opposite direction.

The motive force for the sliders 650 is provided by the pivoting connection with the pivot extensions 250. As the linksets 210 unfold to raise or fold to lower the platform P, the pivoting motion translates to linear motion of the sliders 650 for reciprocating the same within the channeled rails 656. This in turn drives the driven bars 640 causing the guard drive bar 602 to reciprocate. The reciprocation of the guard drive bar 602 permits the follower ends to ride in the helical slot 612 to rotate the safety guard 630 into a stowed position as shown in FIGS. 8A and 8B or a deployed position as shown in FIG. 8C.

Referring back to FIGS. 8A-8C, since the safety guard 630 is not needed when the platform P is stowed, the relative positions of the driven bar 640 and the slider 650 are as shown in FIGS. 8A and 8B where the safety guard 630 is also folded in or stowed. As shown, the slider 650 is at the extreme outward limit of movement and the driven bar 640 is at the extreme inward limit of movement, inward and outward being relative to the linkset assembly 200. In contrast, raising of the platform P deploys the safety guard 630, since the safety guard 630 is most needed in this state. Note the relative positions of the slider 650 and the driven bar 640 in FIG. 8C.

Thus, it may be seen that the reduced stow height of the compact scissor lift 10 allows the mobile device to be placed in a variety of locales heretofore difficult or impossible to access by conventional scissor lifts. The lowering or merging of the linkset assembly 200 lowers the center of gravity of the compact scissor lift 10 and thereby enhance steering stability of the same. Moreover, as a result, the platform P is also lowered so that users do not have to strain overmuch to climb into the platform P and/or load the same with work materials.

It is noted that the compact scissor lift 10 may encompass a variety of alternatives to the various features thereof. For example, more or less than the three stacks of linksets 210 may be employed in the lift.

It is to be understood that the present invention is not limited to the embodiments described above, but encompasses any and all embodiments within the scope of the following claims.

I claim:

1. A compact scissors lift, comprising:

a chassis having an elongated body;

a pair of follower wheels disposed at one end of the body and a pair of steering wheels disposed at the opposite end of the body, the wheels defining a wheelbase;

a lifting linkset assembly disposed substantially within the body, the linkset assembly having space for the steering wheels, wherein the linkset assembly has a stepped rectangular shape including a plurality of stacked linksets, each of the linksets includes:

(i) a wide width section, a stepped portion, and a small width section, the difference between the widths of the sections providing space for the steering wheel wheels;

(ii) an outer lift support frame including a wide width section defining spaced parallel outer support arms and a stepped portion to spaced parallel inner support arms at the small width section;

(iii) an inner lifting frame including a wide width section defining spaced parallel outer lifting arms and a stepped portion to spaced parallel inner lifting arms at the small width section, wherein the inner lifting frame is complementary nested inside the outer lift support frame, both frames being of substantially equal length and pivotable with respect to each other about a common pivot located proximate to the stepped portions; and (iv) pivot extensions at opposite ends of both outer support frame and inner lifting frame, the pivot extensions permitting stacked pivoting between linksets or lifting of the platform;

a platform operatively disposed on top of the linkset assembly;

a hydraulic actuator pivotally disposed within the linkset assembly, the actuator selectively raising and lowering the platform;

a steering system operatively connected to the steering wheels in front of the linkset assembly; and a deployable safety guard mechanism attached to at least one side of the chassis body.

2. The compact scissor lift according to claim 1, further comprising a pivotable locking collar on one of the linksets, wherein the hydraulic actuator comprises a hydraulic cylinder detachably mounted to the pivotable locking collar on one of the linksets.

3. The compact scissor lift according to claim 2, wherein the hydraulic cylinder comprises a cylinder body and a piston rod reciprocating within the cylinder body, the cylinder body being detachably mounted to the pivotable locking collar and the piston rod pivotably mounted to one of the other linksets.

4. The compact scissor lift according to claim 2, wherein the hydraulic cylinder comprises a cylinder body and a piston rod reciprocating within the cylinder body, the piston rod being detachably mounted to the pivotable locking collar and the cylinder body pivotably mounted to one of the other linksets.

5. The compact scissor lift according to claim 1, wherein the hydraulic actuator comprises a hydraulic cylinder detachably mounted to a pivotable locking collar on the chassis.

6. The compact scissor lift according to claim 1, wherein the steering system comprises:

a steering chassis frame disposed in front of the linkset assembly;

a double acting, hydraulic steering cylinder rigidly attached to the steering chassis frame in front of the linkset assembly, the steering cylinder having a steering rod reciprocating therein;

a slidable extension connector at each end of the steering rod, the extension connector being adapted to transfer steering input while maintaining steering geometry within a given length of the chassis, a steering tie link operatively connected to a respective extension connector and a steering arm of a respective steering wheel, and a rail system to counterbalance bending forces on the extension connectors during operation;

wherein reciprocation of the steering rod concurrently reciprocates the extension connectors causing the tie links to translate and leverage the steering arms and thereby rotate the steering wheels about respective virtual steering axes.

7. The compact scissor lift according to claim 6, wherein the rail system comprises:

a pair of elongate slots in the steering chassis frame;

a rectangular rail disposed on the steering chassis frame behind each slot and covering the the frame, each slot and corresponding rail forming a T-shaped channel; and a T-shaped slider disposed on each extension connector, the T-shaped slider being adapted to ride within the T-shaped channel;

wherein the confined linear movement of the extension connector within the rail system counterbalances the bending forces experienced during operation.

8. The compact scissor lift according to claim 6, wherein the rail system comprises a pair of L-shape rail bars spaced between the steering chassis frame and the steering arms, each rail bar having a stepped ledge upon which a respective extension connector rides, the spacing forming a channel confining the movement of the extension connector to be linear which counterbalances the bending forces experienced during operation.

9. The compact scissor lift according to claim 1, wherein the safety guard mechanism comprises:

a female helical screw mounted to a safety guard drive rod, the helical screw having a helical slot formed thereon; and a safety guard fixedly attached to the safety guard drive rod;

wherein selective rotation of the helical screw rotates the safety guard between stowed and deployed positions to stabilize the compact scissor lift during operation on an uneven terrain.

10. The compact scissor lift according to claim 9, further comprising a drive mechanism for selective deployment of the safety guard.

11. The compact scissor lift according to claim 10, wherein the drive mechanism comprises:

an elongate guard drive bar disposed across a substantial width of the linkset assembly, each end of the drive bar having a follower adapted to ride in the helical slot of a respective helical screw to thereby cause the helical screw to selectively rotate as the follower travels along the helical slot; and a rack and pinion system for driving the guard drive bar.

12. The compact scissor lift according to claim 11, wherein the rack and pinion system comprises:

a pair of spaced, elongate driven bars with one end fixedly attached to the guard drive bar, the other end of each driven bar having a lower rack;

a reciprocating driver disposed above a respective driven bar, the driver having an upper rack; and a fixed pinion gear meshed between the upper and lower racks;

wherein reciprocation of the driver in one direction causes the respective driven bar to reciprocate in the opposite direction.

13. The compact scissor lift according to claim 12, wherein the driver comprises:

an L-shaped slider having an upright portion and a horizontal portion;

a bore on the upright portion adapted to be pivotably mounted to a linkset of the linkset assembly; and the upper rack formed on the bottom of the horizontal portion;

wherein unfolding and folding of the linkset assembly causes the slider to reciprocate.

14. The compact scissor lift according to claim 13, further comprising a shaped, channel rail for the slider to confine the movement thereof.

* * * * *